US006212858B1

(12) United States Patent
Breitler

(10) Patent No.: US 6,212,858 B1
(45) **Date of Patent: *Apr. 10, 2001**

(54) PROCESS FOR MANUFACTURING BLISTER PACKS

(75) Inventor: Hans Peter Breitler, Kreuzlingen (CH)

(73) Assignee: Alusuisse Technology & Management Ltd. (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/512,499

(22) Filed: Feb. 24, 2000

Related U.S. Application Data

(60) Continuation of application No. 09/239,874, filed on Jan. 28, 1999, now Pat. No. 6,055,794, which is a division of application No. 08/916,593, filed on Aug. 22, 1997, now Pat. No. 5,911,325, which is a continuation of application No. 08/504,219, filed on Jul. 19, 1995, now abandoned.

(30) Foreign Application Priority Data

Aug. 23, 1994 (CH) ..... 2580/94

(51) Int. Cl.[7] ..... B65B 47/00
(52) U.S. Cl. ..... 53/453; 53/467; 53/475
(58) Field of Search ..... 53/467, 474, 475, 53/559, 453, 568, 560; 206/539, 534.1

(56) References Cited

U.S. PATENT DOCUMENTS 5,911,325 * 6/1999 Breitler ..... 206/539

* cited by examiner

*Primary Examiner*—Peter Vo
*Assistant Examiner*—John Paradiso
(74) *Attorney, Agent, or Firm*—Bachman & LaPointe, P.C.

(57) ABSTRACT

Blister pack, for example to accommodate items such as pharmaceutical items in the form of capsules, coated capsules, ampoules etc., from a base part and a lid part made from strip shaped packaging material. The base part exhibits permanently shaped recesses which are surrounded by shoulders and the lid part exhibits permanently shaped recesses which are surrounded by shoulders; the base and lid parts lie on a plane of symmetry and the base and lid parts are joined at their shoulders over the whole or part of the surface area in the region of the plane of symmetry; the recesses in the base and lid parts which are symmetrically arranged with respect to the plane of symmetry form compartments and the contents are contained in the compartments. The blister packs may be manufactured, for example, by folding or turning over an endless strip of packaging material along a line of symmetry.

21 Claims, 4 Drawing Sheets

PROCESS FOR MANUFACTURING BLISTER PACKS

This application is a Continuation of U.S. Ser. No. 09/239,874, filed Jan. 28, 1999 now U.S. Pat. No. 6,055,794, which is a Division of U.S. patent application Ser. No. 08/916,593, filed Aug. 22, 1997, now U.S. Pat. No. 5,911, 325 which in turn is a continuation of U.S. patent application Ser. No. 08/504,219, filed Jul. 19, 1995, now abandoned.

BACKGROUND OF THE INVENTION

The present invention relates to a blister pack comprising a base part and a lid part made from strip shaped packaging material, a process for manufacturing blister packs and their use.

So called blister packs or push-through packs are known. For example plastic films or plastic laminates or plastic laminates containing a metal foil are press formed in such a manner that a plurality of recesses or cups is created. Shoulders are formed between the individual recesses. The shoulders run completely round the recess and form a flat shoulder. Materials prepared this way form the base part of a blister pack. The base part may be filled with substances i.e. the contents of the blister pack. Known contents for blister packs are e.g. tablets, capsules, coated pills etc. from the pharmaceutical field, packed singly or possibly in pairs in each recess. Subsequently the base part is closed off as a rule using a metal foil such as an aluminum foil or a foil type of laminate that e.g. contains a sealing layer and a metal foil, and the closure completed by sealing with the sealing layer. To remove the contents, for example a tablet or a capsule, the recess is pressed from the base side and the tablet or capsule pushed against the lid containing the metal foil. Due to the inelasticity of the lid material the lid bursts open and permits access to the contents.

With known blister packs that, as described above, are manufactured out of a base part featuring recesses and a smooth lid part, the materials must be relatively thick in order for the wall thickness to be adequate after the press forming operation. Also, depending on the size of the recess relatively broad shoulders are a prerequisite for a practical, useable blister pack.

SUMMARY OF THE INVENTION

The object of the present invention is to propose a blister pack which, in particular in the case of relatively large contents such as capsules containing pharmaceutical preparations, it is possible to keep the height of the recess relatively small and thus to simplify the press forming. Further, the shoulder areas should be smaller and, nevertheless, a secure form of sealing should be obtained between the base and lid parts.

That objective is achieved by way of the invention in that the base part exhibits permanently shaped recesses which are surrounded by shoulders, the lid part exhibits permanently shaped recesses which are surrounded by shoulders, the base and lid parts lie on a plane of symmetry with respect to the openings in the recesses, the base and lid parts are joined at their shoulders over the whole or part of the surface area in the region of the plane of symmetry, the recesses in the base and lid parts which are symmetrically arranged with respect to the plane of symmetry form compartments and the contents are contained in the compartments.

A blister pack may exhibit a row of permanently formed recesses or two or more rows of such recesses, the rows of recesses running parallel to each other. The compartments may, with respect to the length of a blister pack, be arranged side by side or offset with respect to each other. The shoulders usefully form a flat shoulder area. As a rule the blister pack represents a section or segment punched out of an endless strip of packaging material.

Useful are blister packs which are made by shape forming a single strip of packaging material or different packaging materials, the shape forming of the recesses being possible via a single shaping tool. After shaping, the lid material can be placed over the base material. The recesses both in the lid and in the base are in particular shaped in the packaging material permanently into their final dimensions and the recesses in the base part presented as receptacle for filling with the contents. After the filling operation, the lid part with integral recesses is placed over the base part and both parts joined together at the shoulders such that the contents are contained in the compartments or cavities thus formed, this without the contents e.g. causing any further deformation of the packaging material.

Preferred is a blister pack in which one of the lengthways running side edges is a strip shaped packaging material folded over along a line of symmetry. The blister packs may represent an intermediate product and a blister pack that is finally offered for sale may be a segment made from this intermediate product. The intermediate product may be altered by working e.g. by cutting or stamping e.g. in order to remove the folded edge or to shape the contour of the blister pack. For example, a blister pack may exhibit, in the region of the shoulders, weakening or perforations between the individual compartments which make it possible to separate individual portions from the rest. Further, for example in the edge region of each individual portion, provision may be made for a weakening, cutting, notching or the like which makes it possible to destroy the package to such an extent that the compartment is opened and the contents may be removed. Also, holes may be punched out in the region where the lengthways and cross-running perforations overlap. These holes form pull-back flaps for the individual portions.

BRIEF DESCRIPTION OF THE DRAWINGS

The present invention may be more readily understood from a consideration of the accompanying drawings, wherein.

Figure 1A:
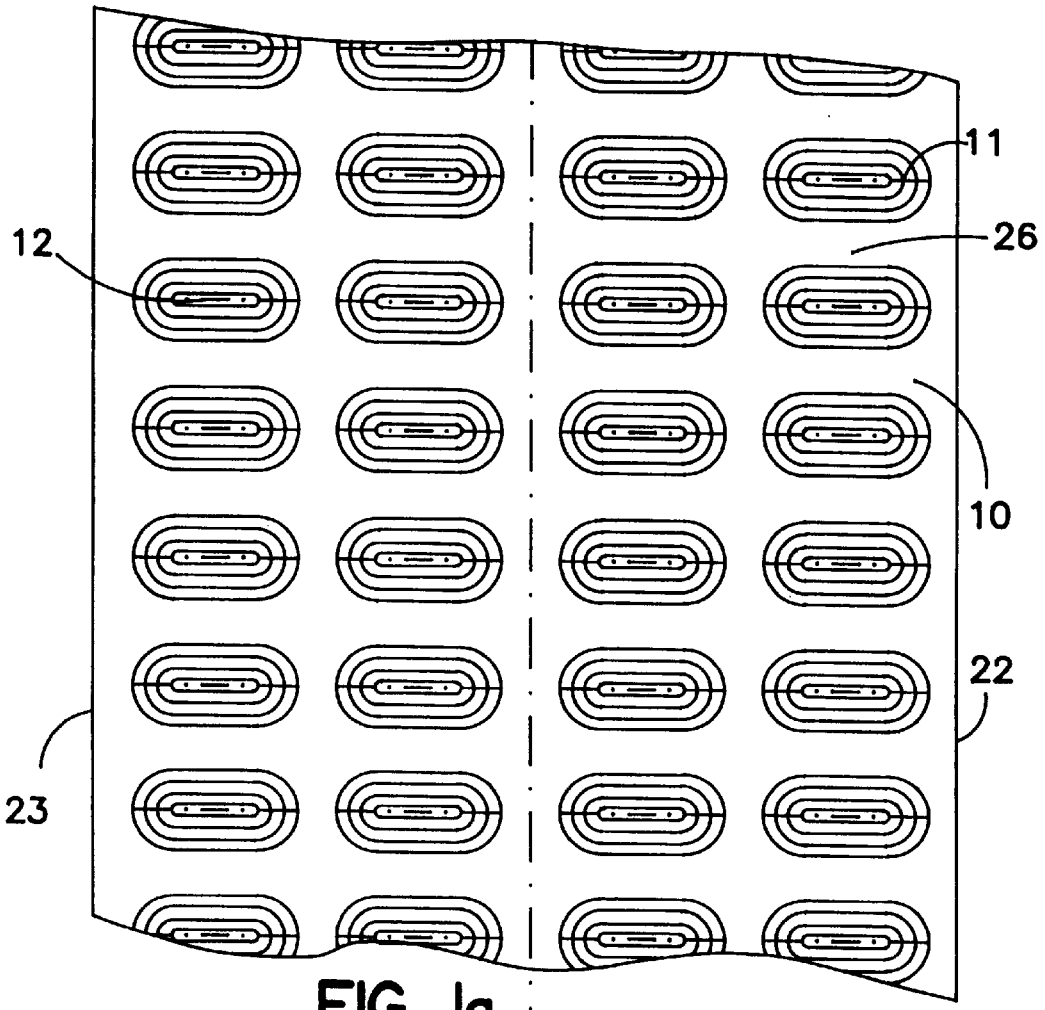
FIG. 1*a* shows a plan view of a strip shaped packaging material in accordance with the present invention in an early stage of manufacture.

DETAILED DESCRIPTION OF PREFERRED EMBODIMENTS;

The blister pack according to the invention is made out of strip shaped packaging material. The packaging material may for example contain a metal layer, usefully a metal foil. The metal foil may be for example 8 to 50 $\mu$m thick, preferably of aluminum or its alloys or it may be an iron or steel foil or for special purposes a noble metal foil. The packaging material may be for example a metal foil with a sealing layer, for example a sealing coating or a sealing film. The sealing coating may be e.g. 2 to 10 μm thick or have a weight per unit area of 0.1 to 10 g/m$^2$. The sealing layer may contain e.g. polyolefins such as polyethylene or polypropylene or polyesters. Fillers such as talc, chalk, lime, mica etc., may be mixed into the sealing layer. The strip shaped packaging material may also be a plastic layer in particular a plastic film or a laminate made up of plastic layers in particular plastic films, or may be a laminate made up of plastic layers and metal layers in particular plastic films and metal foils. Typical plastic films are e.g. films of thermoplastics such as polyamides, polyvinylchlorides, polyvinylidenchlorides, polyesters such as polyethyleneterephthalates or polyolefins such as polyethylene or polypropylene. The thickness of such plastic films may be e.g. from 12 to 50 μm. Preferred, however, are laminates out of two or more of the above mentioned thermoplastics. The thickness of the individual layers may again be 12 to 50 μm. Especially preferred are laminates containing plastic films out of e.g. polyamides, polyolefins such as polyethylene or polypropylene, or polyvinylchloride with a thickness of 12 to 50 μm and metal foils such as 8 to 50 μm thick aluminum foils.

The individual layers, films or foils may be joined together e.g. by adhesives and/or bonding agents. The laminates may, as described above, be manufactured by extrusion, co-extrusion, laminating or extrusion lamination. The individual layers may be subjected e.g. to a plasma or corona treatment to improve their ability to bond to each other.

It is likewise possible to print onto the above mentioned foils and laminates or to deposit a counterproof, to colour the plastic etc. A sealing layer is provided especially on that side of the foil, film or laminate where the shoulders in the blister pack are formed and surround the openings to the recesses.

A packaging material that provides a suitable base material and specially preferred lid material contains a 12 to 50 μm thick layer, preferably 20 to 30 μm thick layer, of oriented polyamide and a 16 to 50 μm thick, preferably 20 to 45 μm thick aluminum foil. This material may exhibit on the other side i.e. the free side of the aluminum a sealing layer, usefully a 5 to 15 μm thick layer of hot sealing coating, usefully 5 to 9 μm thick.

Provided between the film of oriented polyamide and the aluminum foil may be a laminate layer e.g. 3 to 5 μm thick, e.g. a polyurethane adhesive and a primer layer e.g. 1.5 to 3 μm thick, e.g. of epoxy resin.

The layer of oriented polyamide serves as an agent to promote elongation in the shape forming process and in the final blister pack is usefully on the outside of the pack. The sealing layer therefore lies on the inside and so facing the base or lid part.

A packaging material that provides an especially preferred base material and suitable lid material contains a 12 to 50 μm thick layer, preferably 20 to 30 μm thick film of oriented polyamide and a 16 to 50 μm thick, preferably 20 to 45 μm thick aluminum foil. This material may exhibit on the other side i.e. the free side of the aluminum a film of polyvinylchloride, e.g. 30 to 80 μm thick, preferably 50 to 70 μm thick.

Provided between the film of oriented polyamide and the aluminum foil may be a laminate layer of adhesive e.g. 3 to 5 μm thick, e.g. a polyurethane adhesive and, or only, a primer layer e.g. 1.5 to 3 μm thick, e.g. such a layer of epoxy resin.

A 3 to 5 μm thick layer of laminate adhesive e.g. a polyurethane adhesive, may be provided between the aluminium foil and the PVC film.

Very special preference is given to blister packs made from the preferred base material and especially preferred lid material described above.

The packaging materials employed usefully exhibit such rigidity that they can be rolled into coils for stock and e.g. can also be uncoiled on machines and passed through the particular machine for processing. After the recesses have been formed, the resultant base and lid parts are essentially stable in shape, this due to the stiffening effect of the recesses.

The shape and height of the recesses in the base and lid parts may e.g. be symmetrical i.e. the lid part is a mirror image of the base part. Each recess in the base part has a corresponding identical recess in the lid part and both recesses together form a symmetrical compartment.

The base and lid parts preferably exhibit unsymmetrical compartments. The shape and position of the opening of each recess and the related opening of each recess in the lid part are, however, the same and lie one on top of the other.

In each case one recess in the base part and one recess in the lid part forms a compartment or cavity with a clear height x. The height x of each compartment may be made up of up to 1/10 to 9/10, usefully 5/10 to 9/10 from the recess in the base part, and up to 9/10 to 1/10, usefully 5/10 to 1/10, from the recess in the lid part The fraction of height x. contributed by the base part is preferably 6/10 to 9/10. The recesses in the base part are usefully in the shape of a half-shell with entry angle of 30° to 60°, preferably 45°.

The fraction of height x contributed by the recess in the lid is preferably 4/10 to 1/10. The recesses in the lid part usefully exhibit sidewalls e.g. having an entry angle of 60° to 90° and exhibit a flat top surface.

This flat top surface may be printed on or bear a label.

The present invention relates also to a process for manufacturing the blister packs from strip shaped packaging material by creating recesses in the strip shaped packaging material, filling the strip material forming the base part, covering the base part with lid material and permanently joining together the base and lid parts, According to the present invention a strip shaped packaging material usefully exhibits a line of symmetry running lengthways or n lines of symmetry running lengthways and n−1 lines of separation, where n is a number of magnitude 2 or more e.g. 2 to 6 and the blister pack is produced in the following in the steps:

a) On both sides and parallel to each line of symmetry at least one row of permanently shaped recesses that are delimited by surrounding shoulders is created in the strip shaped packaging material and b) the strip shaped packaging material is weakened along the line(s) of symmetry and separated along the lines of separation, and c) after step a) or step b) the recesses in the strip shaped packaging material on one side of the line of symmetry are filled with the contents thus forming a base part, and d) the non-filled side of the strip shaped material, on the other side of the line of symmetry, is folded over in such a way that the folded over part of the strip shaped packaging material forms a lid, and that the shoulders of the base and lid parts touch each other, and e) the touching shoulders of the base and lid parts are joined together over the whole area or part thereof, as a result of which each recess in the base part is covered over by a recess in the lid part, and the recesses of the base part and the recesses of the lid part form compartments, and the contents are accommodated in the compartments.

In a modified version the packaging material may be in two strips. The packaging material of the two strips may be the same or different. The lengthways running line of symmetry is situated between the two strips which run symmetrical and parallel through the following steps:

a) on both sides of the line of symmetry at least one row of recesses delimited by surrounding shoulders is created in both packaging materials. The recesses are usefully created in both strips using the same tool.

b) This step is omitted as two independent strips are already available.

c) after step a) the recesses in the strip shaped packaging material on one side of the line of symmetry are filled with the contents thus forming the base part, and d) the non-filled strip shaped packaging material, on the other side of the line of symmetry, is tilted over in such a way that this strip shaped packaging material forms the lid part and the shoulders of the base and lid parts touch, and e) the touching shoulders of the base and lid parts are joined together over the whole area or part thereof, as a result of which each recess in the base part is covered over by a recess in the lid part, and the recesses in the base part and the recesses in the lid part form compartments, and the contents are accommodated in the compartments.

Creating the recesses in the strip shaped packaging material may e.g. be done by drawing processes such as stretching, stretch-drawing or deep-drawing and in particular by shaping with shaping tools which produce straightforward elongation of the packaging material. Cold shape forming is especially preferred. The recesses may be made continuously or in steps. Usefully the recesses are made in particular in an endless e.g. roll of strip shaped packaging material. The shaping with forming tools may be performed intermittently, a clamping tool holding the strip shaped packaging material securely in place and a shaping tool forming the recess by pressing and elongating the material.

In the first described process the strip shaped packaging material may be weakened e.g. by perforating, notching or cutting through part of the thickness along the line(s) of symmetry.

The recesses are situated such that one line of symmetry lies between at least two rows of recesses and the recesses, and also the shoulder regions between the recesses continue mirror like over the whole length of the strip. If more than one row of recesses is provided on each side of the line of symmetry, then the recesses may lie on the same axis or displaced with respect to one another. However, the feature that the recesses must lie mirror like along a line of symmetry remains. In keeping with the strip width and the process, it may be useful to provide a plurality of lines of symmetry. As a result a dividing line is created between two lines of symmetry. The dividing line runs parallel to the line of symmetry and, as the name implies, the strip shaped material is divided along the dividing line later in the process.

If two lines of symmetry are foreseen across the breadth of the strip, there is a dividing line between them, if there are three lines of symmetry then two dividing lines etc. After forming the recesses, the strip shaped packaging material is weakened along the line or lines of symmetry or separated along the dividing lines.

Immediately after forming the recesses or after the weakening and separating, the recesses in the strip shaped packaging material on one side of the line of symmetry may be filled with the intended contents. The contents may e.g. be pills, coated pills, tablets, capsules, soft gelatine capsules, ampoules, all e.g. containing pharmaceutical active ingredients in their galenic forms. It is also possible to package semi-luxury materials and foodstuffs this way. This could be sweets, spices or the like. In the broadest sense, such recesses could also be filled with technical articles such as batteries in the form of button shaped cells or filigree components for machines or apparatus, or electronic components e.g. for sale of spare parts.

The contents are placed in the recesses on one side of the line of symmetry; this side of the packaging material featuring recesses thus constitutes a base part. Further recesses are situated in a mirror-like arrangement on the other side of the line of symmetry. These recesses are empty. As described previously, the strip shaped packaging material may be weakened along the line of symmetry. It goes without saying that this weakening may be provided only after the filling operation. If the line of symmetry has been weakened, then the strip shaped packaging material may be folded along this line of weakness and the folded over part of the strip shaped packaging material then forms the lid part. Unless recesses have been removed from the strip shaped packaging material, flat shoulder areas remain both on the base and on the lid parts. As there is a line of symmetry, the recesses come precisely together and the shoulder areas precisely on top of each other.

The shoulders and in particular the smooth and flat shoulder areas are joined together either wholly or in part. This connection may be achieved as a result of the strip shaped packaging material containing a sealing layer on the shoulder side and the sealing layer being activated e.g. by pressure and/or heat. According to the sealing tool which applies the pressure and/or heat to the strip shaped packaging material, the shoulders may be joined to each other either over the whole or only part of the contact area. As a rule at least one the shoulders on the lid part or the base part or on the base and lid parts feature a sealing layer or sealing coating. The shoulders are joined by means of a sealing tool, in particular a contour sealing tool under the influence of heat and/or pressure. Sealing with a contour sealing tool makes it possible to seal only part of the shoulder contact area, each recess being provided with a seal all around it. Seal-free zones may be intended for tear-off flaps. It is also possible, to apply an adhesive to the strip shaped packaging material in the shoulder area either wholly or in part e g. by rolling, brushing, raking or spraying, this preferably after forming the recesses. The adhesive may be a contact adhesive or the adhesive may be activated by pressure and/or heat. It may be e.g. a single or two component epoxy or polyurethane adhesive, or a vinylacetate adhesive. Each recess in the base part is therefore covered over by a recess in the lid part and the recesses in the base and lid parts form compartments, and the contents are accommodated in these compartments. The blister packs exhibit therefore a plane of symmetry that lies exactly at the points of contact between the base and lid parts.

The connection in the region of the shoulders may be permanent or may be able to be peeled back. By permanent is meant that the join cannot be undone and the contents of the pack can be removed only by destroying the packaging material, for example by tearing, cutting etc. It may also be possible to peel back the joined areas i.e. the adhesion or sealing layer breaks within itself or two layers delaminate. This way the base and lid parts remain intact on removal of the contents.

Initially a preliminary product is produced, also in strip form, out of the strip shaped packaging material i.e. endless blister packs are produced. The strip shaped packaging material or the product prior to the blister packs may be made to size by cutting to length, cutting or stamping into the form of the actual blister pack. For example, after making the lines of weakness or dividing lines and before filling the recesses, the strip shaped packaging material may be already cut or stamped out. This method is less advantageous and therefore preference is given to cutting or stamping out the strip shaped packaging material to pack size i.e. the still strip shaped blister pack with the filled base part covered with lid part, both parts of which already being joined together. This sequence of process steps may also include dividing the blister pack into individual portions by creating lines of weakness in the lengthways and transverse directions in the region of the shoulders between the compartments. Likewise, holes may be stamped out to provide pull-back flaps where the lengthways and transverse perforations intersect. An edge contour of any desired form may be produced at the same time as the stamping and cutting. The finished, stamped blister packs may then e.g. be passed on to a station for packing into cartons.

The blister pack and the process for manufacturing the blister packs according to the invention it is possible e.g. to achieve a reduction in area of up to 40%. So, for example, a known blister pack with 10 recesses exhibits outer dimensions of 144×98 mm, whereas according to the invention, for the same contents i.e. again 10 recesses or compartments, outer dimensions of 115×77 mm can be achieved. The contents in this example is a capsule 9.4 mm in diameter and 22.6 mm long.

FIGS. 1 to 5 explain the present invention in greater detail. FIG. 1 shows a strip shaped packaging material 10 which already exhibits two double rows of recesses 11, e.g. made by elongating the packaging material. The strip shaped packaging material 10 exhibits a line of symmetry 13. provided on both sides of the line of symmetry 13 are recesses 11, and in mirror image, recesses 12. The strip shaped packaging material may be much broader than shown here and may exhibit e.g. a plurality of rows of recesses arranged in rows of one, two or three etc., on both sides of the line of symmetry 13. If the strip shaped packaging material is broader, there may be more than one line of symmetry 13. During the process of manufacturing the blister packs, the material may be divided into two or more strips along the dividing lines corresponding to the lines of symmetry. For example, a side edge of the strip shaped packaging material 10 may be a dividing-cut edge 22, whereas the other side edge represents the original edge 23 of the strip shaped packaging material.

The strip shaped packaging material 10 exhibiting recesses 11, 12 has a line of symmetry 13. Recesses 11 which later form the lid are situated on one side of the line of symmetry 13 and recesses 12 which belong to the base part and will receive the contents are situated on the other side of the line of symmetry 13. The recesses 11 and 12 are all surrounded by shoulders 25. A weakening of the strip shaped packaging material is provided along the line of weakness. The line of weakness may be created e.g. by cutting through part of the thickness of the strip shaped material 10, or by means of notches, scratches or perforations. The weakening of the material may also take place mechanically or, if desired, also by thermal measures e.g. using laser beams.

Figure 1B:
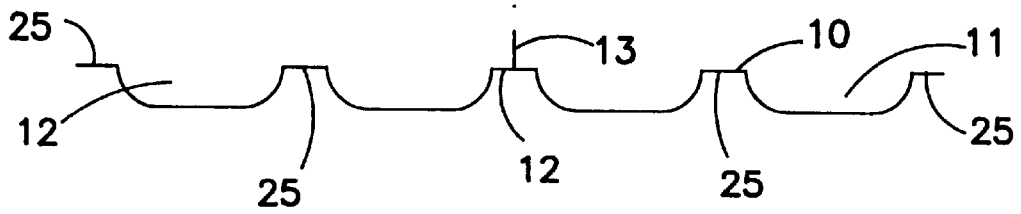
FIG. 1*b* is a cross-section through the strip of FIG. 1*a;*

FIG. 1*a* shows in plan view the strip shaped packaging material 10 and FIG. 1*b* a cross-section through the strip shaped packaging material 10. In subsequent steps in the process of manufacturing blister packs according to the invention the contents may be added to the recesses 12. The contents may be e.g. soft gelatine capsules, capsules, coated pills, tablets or ampoules.

Figure 2A:
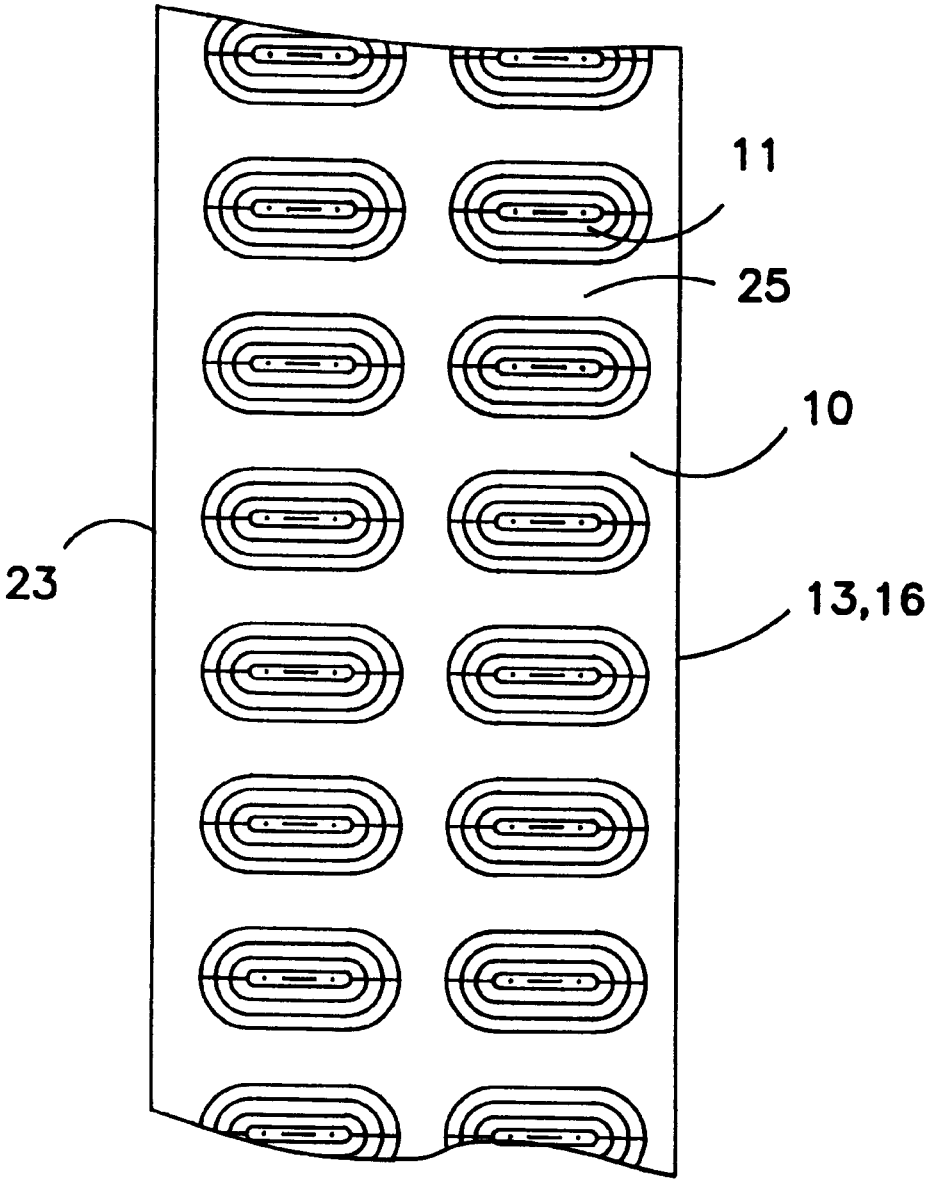
FIG. 2*a* shows a plan view of a strip shaped packaging material according to the present invention in a further stage of manufacture.
Figure 2B:
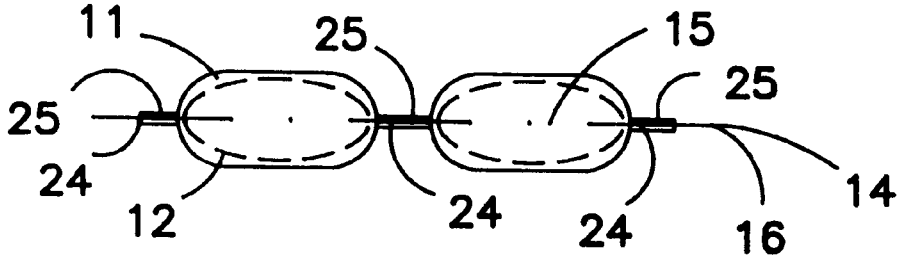
FIG. 2*b* is a cross-section through the strip of FIG. 2*a;*

FIG. 2 shows a further stage in the process of manufacturing blister packs according to the invention. FIG. 2*a* shows again a plan view, FIG. 2*b* a cross-section through a blister pack being made out of strip shaped packaging material 10. As shown in that FIG., the strip shaped packaging material 10 has been folded along the line of symmetry 13 in such a way that the shoulders in both strips come into contact. The recesses 11 now belong to the lid and recesses 12 to the base part. As a result of the folding operation a fold 16 has been formed and, as a result of the sealing 24, the base and lid parts have been joined at the shoulders. The recesses 11 and 12 in the lid and base parts respectively form compartments that hold the contents 15. A line of symmetry 14 may be recognized in the blister pack as it is being made. In the present case the strip shaped packaging material 10 is symmetrical or mirror imaged identical on both sides of the plane 14. The seal 24 between the shoulders 25 is also in the region of the plane of symmetry 14. The recesses in the base and lid parts may, however, be different in height, then only the edges of the recesses and the shoulders are symmetrical with respect to each other.

Figure 3:
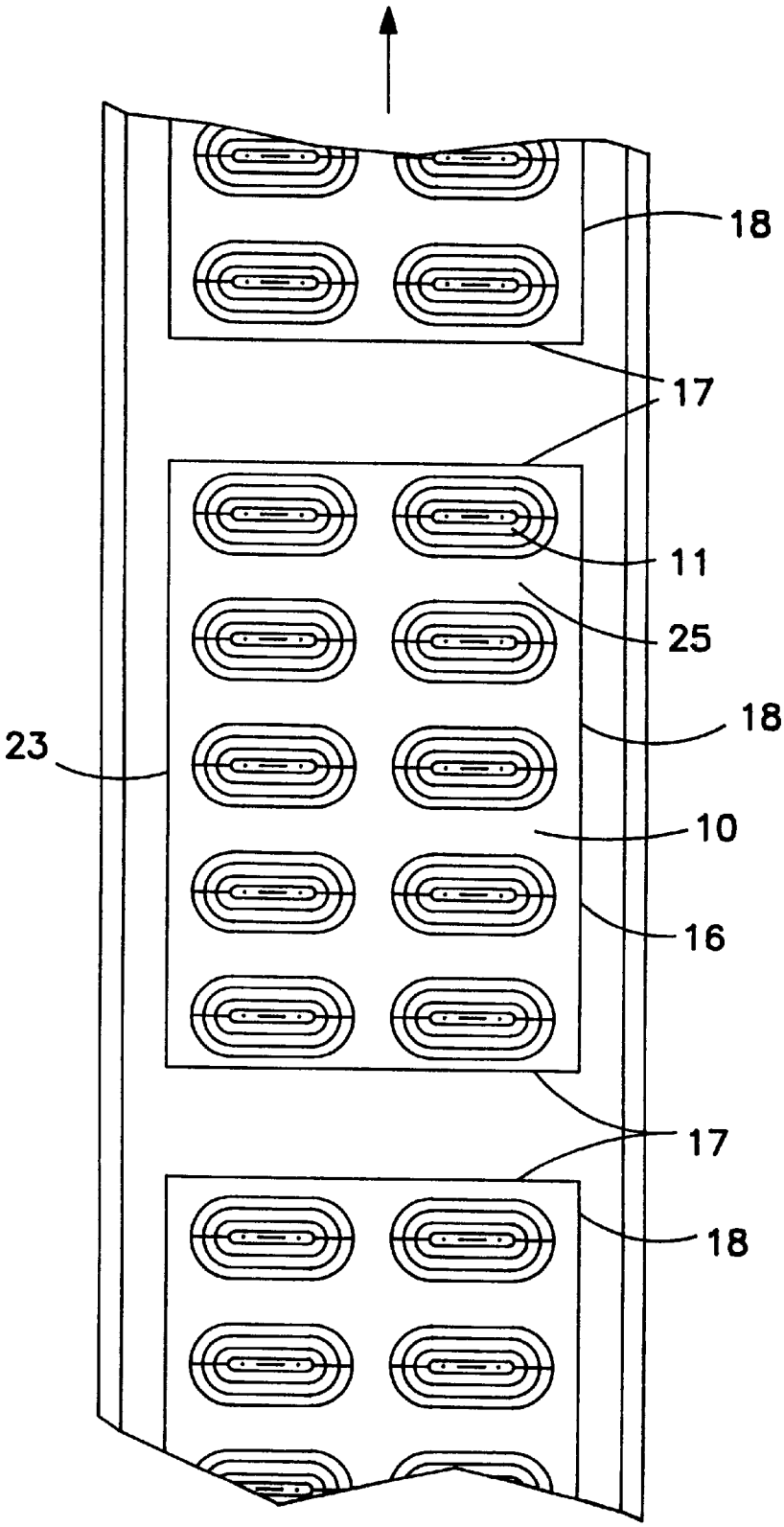
FIG. 3 shows a plan view of a strip shaped packaging material in a still further stage of manufacture.

FIG. 3 shows a further stage in the manufacture of the blister packs in question. The blister packs 18 are made out of the strip shaped packaging material 10 and exhibit at one edge the fold 16 and the other the edge 23. The recesses 11 in the lid are surrounded by shoulders 25. By means of a dividing process, such as stamping or cutting to form cut edges 17, the endless strip has been divided into individual blister packs 18. The division of the strip may, apart from cutting or stamping, be performed by a thermal method such as a laser beam. The blister packs 18 may be packed in the present form e.g. into cartons that also accommodate e.g. an accompanying leaflet, or they may be stacked into larger lots and packed etc. It is also possible to prepare the blister packs further as ready-made items.

Figure 4:
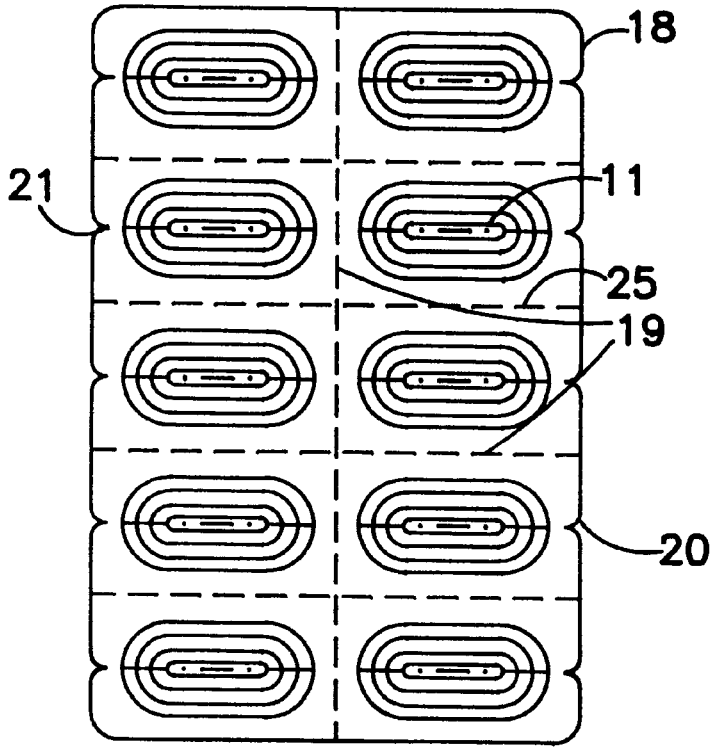
FIG. 4 shows a plan view of a strip shaped packaging material of the present invention.

FIG. 4 shows such a ready-made blister pack 18 in plan view. One can recognize the recesses in the lid 11, below this the contents, for example an ampoule, capsule, soft gelatine capsule, pill or coated pill. The recess 11 is surrounded by the shoulders 25. Part of the further preparation involved cutting out the outer contour 20. For example the fold 16 shown in the version according to FIG. 3 has been removed and e.g. an aid to tearing 21 provided. The shaping of the outer contour 20 is normally done by stamping. Also, perforations 19 running in the region of the shoulders have been provided between the individual compartments formed by the recesses in the lid 11 and the corresponding recesses in the base. With the aid of theses perforations 19 it is possible to separate individual or several compartments and their contents from the rest of the pack, for example a daily dosage, for the purpose of keeping or consumption. The tearing aid 21 could also be provided by stamping etc. within the outer contour in the region of the perforations 19.

If the contents of the compartments are to be removed, the compartment may be opened along the tearing aid 21 and the contents taken out. It is also possible for the contents to be removed by applying pressure to the base part. The contents then press against the lid part and, as a result of the stresses produced and the inelasticity of the material, the lid part bursts open and allows access to the contents. For example by contour sealing the base and lid parts and/or providing punched lines it is possible to provide pull-back flaps. The contents can then be made accessible by gripping the flap and peeling the base and lid parts apart.

The blister pack 18 shown in FIG. 4 may, for example, also be packed in cartons or stacked into large pack form and then packed.

Usefully, the shoulder areas are chosen sufficiently broad that on stacking the blister packs one on top of the other, the recesses of an upper layer of blisters find space between the recesses in the layer of blisters below. This way the height required to stack pairs or more of blister packs can be reduced.

Figure 5:
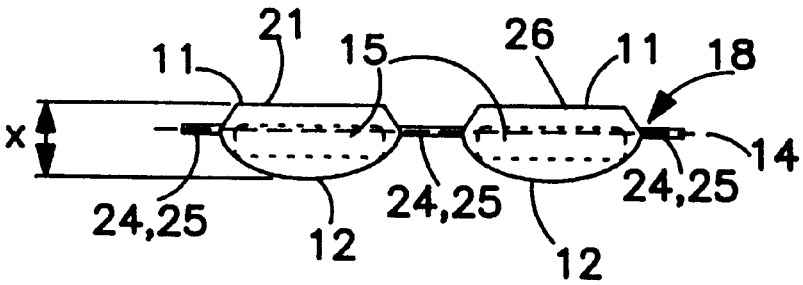
FIG. 5 shows a cross-section of a preferred blister pack of the present invention.

FIG. 5 shows a cross-section through a preferred version of a blister pack according to the present invention. The blister pack 18 exhibits recesses in the lid part 11 and recesses in the base part 12 arranged about a line of symmetry 14. The recesses 11 and 12 form compartments for the contents of the pack 18 e.g. for the capsules 15. The clear height x in the compartment is made up of e.g. ⅓ from the recess in the lid part and ⅔ from the recess in the base part 12. The recesses in the base part 12 are dish-shaped or half-shell-shaped with an entry angle of approximately 45°, whereas the recess in the lid part exhibits steep walls and a flat top. The half-shell-shaped recess in the base part 12 can be readily filled and, as a result of the forming ratio (dish width to depth) of for example 5:1 to 0.5:1 and preferably 3:1 to 1:1, the shaping of the half-shell does not place high demands on the packaging material. The dish shape holds the contents securely in place during subsequent stages of the packaging process.

The recess in the lid part 11 exhibits a still smaller shape forming ratio of e.g. 10:1 to 0,5:1, preferably 5:1 to 2:1 and more preferably 3:1 to 2:1, and very steep walls i.e. of up to 90° can be created. This makes it possible to form smooth, flat top surfaces 26 that may be printed on, for adhesion purposes or designed in some other way.

Also recognizable in FIG. 5 is the sealing 24 between the shoulders 25 in the region of the plane of symmetry 14.

The present invention relates also to the use of the blister packs for holding contents such as pills, coated pills, tablets, capsules, soft gelatine capsules, ampoules, foodstuffs such as sweets, spices or technical articles. Especially preferred is the use of the blister packs for soft gelatine capsules.

What is claimed is:

1. Process for manufacturing blister packs, which comprises:

providing strip shaped packaging material including a base part and a lid part connected to the base part, wherein the base part includes a plurality of preformed, permanently shaped base recesses each of which are surrounded by shoulders, and wherein said lid part includes a plurality of preformed, permanently shaped lid recesses each of which are surrounded by shoulders;

filling the recesses in the base part with contents in the form of at least one of pills, coated pills, tablets, capsules, soft gelatine capsules, ampoules, foodstuffs and technical articles;

covering the base part with said lid part so that the shoulders of the base and lid parts touch each other;

joining together the touching shoulders of the base and lid parts so that each recess in the base part is covered over by a recess in the lid part; and forming a blister pack with compartments therein by said covering over of the recesses in the base part by the recesses in the lid part, wherein each compartment is surrounded by the touching shoulders of the base and lid part, and including the step of providing that the compartments are larger than the individual recesses in the base part and are also larger than the individual recesses in the lid part, and wherein the contents are accommodated in the compartments.

2. Process according to claim 1, including the step of providing a strip shaped packaging material with at least one line of symmetry running lengthwise thereof, and creating in the strip shaped packaging material on both sides of and parallel to each line of symmetry at least one row of said recesses delimited by said surrounding shoulders, and folding the non-filled side of the strip shaped packaging material over the filled side of the strip shaped packaging material to form said compartments.

3. Process according to claim 2, including the step of providing at least two rows of said recesses on each side of each line of symmetry.

4. Process according to claim 2, including weakening the strip shaped packaging material along the line of symmetry by at least one of perforation, notching, and cutting through a part of the thickness thereof.

5. Process according to claim 2, including forming a fold line along the line of symmetry.

6. Process according to claim 1, wherein the strip shaped packaging material is at least one of cut to length in pack size and stamped with an outer contour.

7. Process according to claim 6, wherein the strip shaped packaging material is stamped with an outer contour which includes stamping to provide an aid to tearing adjacent each compartment.

8. Process according to claim 1, including the step of permanently joining together the touching shoulders in the base and lid parts.

9. Process according to claim 1, including the step of joining together the touching shoulders in the base and lid parts so that they can be peeled apart.

10. Process according to claim 1, including the step of providing that the strip shaped packaging material for at least one of the lid part and the base part contains at least one metal layer and at least one plastic layer.

11. Process according to claim 1, including providing that the recesses in the base part are in the shape of a half-shell with entry angle of 30° to 60°.

12. Process according to claim 1, including providing that the recesses in the lid part exhibit sidewalls having an entry angle of 60° to 90° and exhibit a flat top surface.

13. Process according to claim 1, including providing that the strip shaped material for at least one of the lid part and the base part contains a first layer that is 12 to 50 microns thick of oriented polyamide, a second layer that is 16 to 50 microns thick of aluminum foil, and a third layer that is 5 to 15 microns thick of a sealing layer.

14. Process according to claim 1, including providing that the strip shaped material for at least one of the lid part and the base part contains a first layer that is 12 to 50 microns thick of oriented polyamide, a second layer that is 16 to 50 microns thick of aluminum foil, and third layer that is 30 to 80 microns thick of polyvinylchloride film.

15. Process according to claim 1, including providing that the strip shaped material for at least one of the lid part and the base part contains a polyamide layer on the outside of the pack.

16. Process according to claim 1, including providing that the recesses in the base part are in the shape of a half-shell with a forming ratio of width to depth of 5:1 to 0.5:1, and the recesses in the lid part exhibit a flat top surface with a forming ratio of width to depth of 10:1 to 0.5:1.

17. Process according to claim 1, including providing that the base part and lid part are continuous.

18. Process according to claim 1, including providing that the compartments are symmetrical.

19. Process according to claim 1, including providing that the strip shaped packaging material exhibits at least one line of symmetry running lengthwise.

20. Process according to claim 19, including providing that the strip shaped packaging material exhibits n lines of symmetry running lengthwise, and n−1 lines of separation, where n is a number of magnitude 2 or more.

21. Process according to claim 1, including the step of providing that the compartments having a height x, and providing that the recess in the base part and the recess in the lid part are substantially equal in size and are a mirror image of each other.

* * * * *